US005452772A

United States Patent [19]

Van Den Bergh

[11] Patent Number: 5,452,772

[45] Date of Patent: Sep. 26, 1995

[54] APPARATUS FOR STEERING THE FOREMOST PART OF THE DRILLPIPE

[76] Inventor: Johannes W. H. Van Den Bergh, Lindenlaan 27, NL-1861 HA Bergen, Netherlands

[21] Appl. No.: 859,307

[22] PCT Filed: Nov. 20, 1990

[86] PCT No.: PCT/NL90/00173

§ 371 Date: May 26, 1992

§ 102(e) Date: May 26, 1992

[87] PCT Pub. No.: WO91/08370

PCT Pub. Date: Jun. 13, 1991

[30] Foreign Application Priority Data

Nov. 23, 1989 [NL] Netherlands ..... 8902894
Aug. 28, 1990 [NL] Netherlands ..... 9001883

[51] Int. Cl.[6] ..... E21B 7/08

[52] U.S. Cl. ..... 175/74; 175/101; 175/107

[58] Field of Search ..... 175/61, 62, 73, 175/74, 76, 101, 107, 325.3; 166/117.7

[56] References Cited

U.S. PATENT DOCUMENTS 4,754,821 7/1988 Sweitlik ..... 175/325
4,811,798 3/1989 Falgout et al. ..... 175/73
4,844,178 7/1989 Cendre et al. ..... 175/73
4,848,490 7/1989 Anderson ..... 175/76 X
5,012,877 5/1991 Winters et al. ..... 175/80
5,220,963 6/1993 Patton ..... 175/61 X

*Primary Examiner*—Roger J. Schoeppel
*Attorney, Agent, or Firm*—Spencer, Frank & Schneider

[57] ABSTRACT

An apparatus for steering a forward end of a drill string having a motor. The apparatus includes a shaft connected to the motor. The shaft has a thickened portion. Drilling fluid having an operating mass flow rate, and a housing are provided. A piston is enclosed within the housing, and is displaceable by a mass flow of the drilling fluid. The piston has a central opening for the passage of the drilling fluid and has the shaft extending therethrough. The piston includes a displaceable sleeve within the housing, a first spring urging against the sleeve and the housing, and a displaceable piston part coaxial with the sleeve within the housing. The piston part has an inwardly directed collar movable towards the thickened portion of the shaft by an increase of the mass flow rate of the drilling fluid, whereby the collar and the thickened portion cooperate to reduce a size of the central opening, thus causing the drilling fluid to exert a thrust pressure on the piston part so that the piston part and the sleeve are moved abuttingly together against the urging of the first spring to an adjusting position. The piston is provided with a second spring exerting a spring force less than the first spring and having a first end urging against the sleeve, and a second end urging against the piston part. The apparatus further includes an adjusting organ connected to the sleeve and being displaceable when the piston is in the adjusting position.

14 Claims, 14 Drawing Sheets

APPARATUS FOR STEERING THE FOREMOST PART OF THE DRILLPIPE

BACKGROUND OF THE INVENTION

The invention relates to an apparatus for directing and steering the foremost part of a drillstring for earth drillings.

Such an apparatus is known.

When, by an embodiment of the known apparatus, one has to drill further to create a side branch starting from a vertical bore, the drillstring is first retrieved from the borehole, a wedge shaped guiding piece is next let down into the borehole, and subsequently the drillstring is again lowered in the borehole. The wedge shaped guiding piece deviates the foremost part of the drillstring sidewards, so that the borehole is drilled in a more horizontal direction, to form the required side track.

With another embodiment of the known apparatus for the forming of a side branch starting from the vertical bore, the bottom end of the drillstring includes a bend piece which carries the bit and a drilling motor. To form the side branch, the bit is driven by the drilling motor and non rotating drillstring, and consequently is drilled ahead sidewards to form the required side track.

Another embodiment of the known apparatus for yielding a sideward deviation from the vertical borehole comprises one or more stabilizers for deviating the foremost part of the drillstring.

All these embodiments of the known apparatus require, for the incorporation of the wedge shape guiding piece, or of the bend piece at the bottom end of the drillstring, or of the stabilizers, that the whole drillstring be retrieved from the borehole, and to subsequently lower down the tapered shaped guiding piece in the borehole, or to incorporate the bend piece or the stabilizers at or nearby the bottom end of the drillstring.

This repetitive retrieving of the drillstring out of the borehole, to make the necessary arrangements for further sidewards drilling starting from the vertical borehole, is very time consuming and costly.

The invention intends to eliminate these disadvantages of the known apparatus or apparatuses.

SUMMARY OF THE INVENTION

The apparatus, according to the invention, includes a housing having a piston, which is displacable between two or more positions by the massflow of the drilling fluid through the drillstring. The piston is connected with at least one adjusting organ, which co-operates with devices for directing and guiding of the end of the drillstring.

By the steering of the piston with the massflow of the drilling fluid through the drillstring, the guiding devices at the end of the drillstring can be controlled from the earth surface. Thus, when drilling the side branch starting from the vertical first bore, it is no longer necessary to retrieve the total drillstring repetitively from the borehole. The housing in which the piston is incorporated can adequately be part of the drillstring.

By an embodiment of the apparatus in accordance with the invention, the devices for the directing and guiding of the bottom end of the drillstring comprise one or more stabilizer blades. These stabilizer blades can be steered by the piston by the massflow of the drilling fluid.

By another embodiment of the apparatus in accordance with the invention, the devices comprise two, hinged interconnecting housing parts. The piston is incorporated in one housing part. The adjusting organ connected to the piston cooperates with an adjusting organ solidly connected to the other housing part. By displacing one adjusting organ with respect to the other adjusting organ, the position of the housing parts with respect to each other is changed.

In one of the housing parts the bit bearing is accommodated, and in the other housing part a drive motor for the bit is accommodated.

In another embodiment of the invention apparatus, the devices comprise at least one bearing of a bit. This bearing is displacable transverse to the housing under steering of the adjusting organ and the piston connected thereto. By the displacement of the bearing from the centerline of the housing, the shaft of the bit is deviated by an angle from the center line. The piston is displacable against a spring force in the housing part from a rest position to an adjusted position.

By a further embodiment of the invented apparatus, the devices comprise two telescoping housing parts. At least one of the housing parts can be provided with one or more expandable clamping organs that fix the housing part in the borehole.

By this form of execution, the foremost part of the drillstring can be moved forward in the borehole with a caterpillar movement by steering of the massflow of the drilling fluid.

Further characteristics and special features of the invention will appear hereafter following a description of some embodiment examples.

DESCRIPTION OF THE PREFERRED EMBODIMENTS

Figure 1:
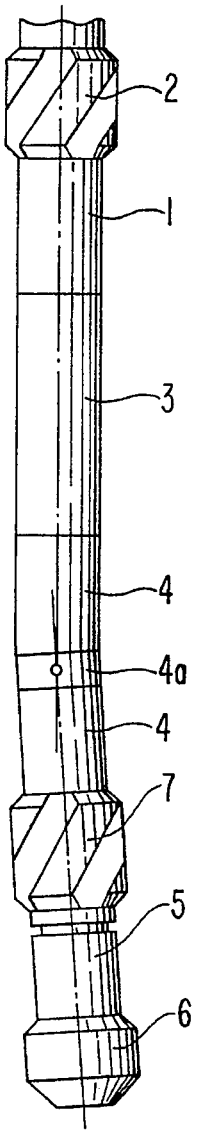
FIG. 1 is a schematic illustration of a drilling motor connected to a drillstring.

FIG. 1 is a schematic illustration of an embodiment of a drilling motor connected to the end of the drillstring (1). At a side of the drillstring a stabilizer (2) is accommodated in front of the downhole motor. The downhole motor comprises the housing in which the drive motor (3) is situated, and the connecting housing (4) and fixed bend (4a), between which a connecting shaft is situated. The connecting shaft interconnects the shaft of the drive motor with the shaft of the bearing housing (5). At the end of the bearing housing the bit is located (6). In the schematic example a stabilizer (7) is also incorporated at the bearing housing.

FIGS. 2A–2D show a partly exploded perspective longitudinal view of the connecting housing (4), in which the components of the adjusting system, and the other components of the connecting housing are illustrated, partly in view, and partly in longitudinal section.

The connecting housing (4) is divided in two parts: the upper housing part (8) and the lower housing part (9), which have a hinged interconnection. In this embodiment of the invention the connection consists of a connecting and coupling hinge, whereby the upper housing part (8) is provided with an inserting part (10), which penetrates through the hinge joint into the lower housing part (9).

The axial pressure forces are transferred from the upper housing part (8) to the lower housing part (9) by a ring with a spherically shaped surface (11) in the upper housing part (8), and a ring and bowl shaped surface (12) on the lower housing part (9).

The axial pulling forces are transferred from the lower housing part (9) by a ring with a spherically shaped surface (13). Ring (13) is supported against a ring shaped shoulder (14) provided in lower housing part 9 and a ring with a bowl shaped surface (15) which is accommodated tightly on the inserting part (10). The ring (15) leans against a locking ring (16), which leans against a ring shaped shoulder (17) provided on the inserting part (10). If necessary, the rings (13, 15 and 16) can be locked against rotation, and for assembly reasons divided in two parts. Rings (15) and (16) grip each other by locking edges (18) and are bolted together, by which the dividing surfaces of the rings (15 and 16) are rotated 90°, with respect to each other, around the axial centerline of the inserting part (10), which is not indicated on the drawing.

The lower housing part (9) is arranged at the upper end with a ring and spherically shaped surface (19), which leans against a ring with a bowl surface (20). Ring (20) is located on a cylindrical sealing ring (21), which is arranged around a contracted part (22) of the upper housing part (8).

The spherical and bowl shaped surfaces (11, 12, 13, 15, 19, and 20) all have a common spherical rotation center (23), and are provided with grooves (24, 25 and 26) in which sealing rings are located so that drilling grit of the drilling fluid cannot penetrate into the hinge joint.

In the grooves (24, 25 and 26) at the fluid side scraper seals can be installed, to protect the sealing rings and the contact surfaces from the penetration of drilling grit.

The inserting part (10) is provided with channels (27).

The channels are in connection with the drilling fluid and the interior of the hinge joint. The inner side of the hinge joint is plugged off with a recessed sealing nut (28), provided with an opening. In the channels slidable plugs are installed, which allow the equalizing of differential pressure between the interior of the hinge joint and the drilling fluid in the drive housing parts (8, 9).

The number of channels are adapted according to their dimensioning, so that they contain a sufficient amount of lubricant, compensating for compressed air bubbles retained during the assembly.

The hinge joint is provided with a greasing nipple and lockable deaerating opening, not shown in the drawing.

At the inner side of a cylindrical sealing ring (21), a ring shaped recess (29) is provided, in which in an axial direction with respect of the centerline of the upper housing part (8), a movable ring (30) is located. The recess (29) is connected via narrow channels with the outside of the upper housing part (8) and with the space (31) between the cylindrical sealing ring (21) and the spherical and bowl shaped hinging surfaces (11 and 12). The narrow channels compensate for pressure differential across the seal. The recess (29) is dimensioned to contain sufficient spare lubricant, to compensate for lubricant leak losses and to compensate for the compression of air bubbles, which may be unexpectedly present after assembly. The cylindrical sealing ring (21) is provided with a lubrication nipple and a lockable deaerating opening, which are not shown on the drawing.

The inserting part (10) extends through the rings (13 and 16) in the lower housing part (9), and functions as an inserting adjusting organ (32). This inserting adjusting organ (32) is provided with two parallel surfaces (33) at opposing sides at the outer circumference (see FIG. 3) which are closely fit against two parallel surfaces (34) provided to segments (35) at the inner side of the lower housing part (9). Segments (35) can be fixed parts of the lower housing part (9).

Figure 3A:
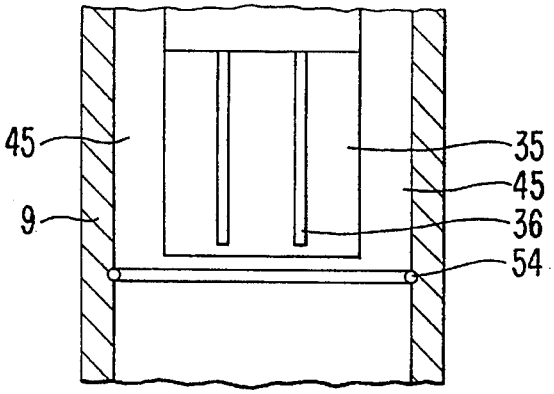
FIGS. 3A–3C are respective cross-sectional and longitudinal illustrations of the adjusting organ taken along section line 3—3 in FIG. 2B.
Figure 3B:
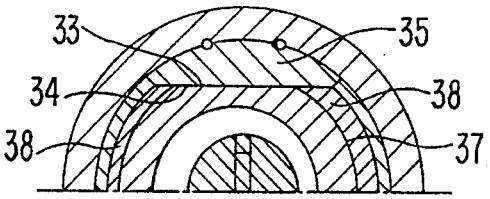
Figure 3C:
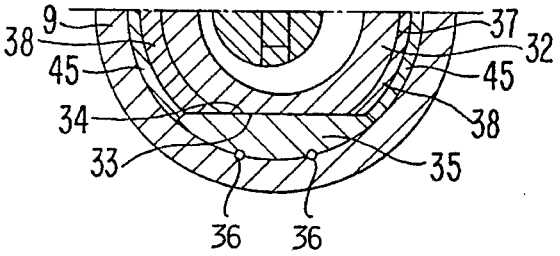
Figure 2A:
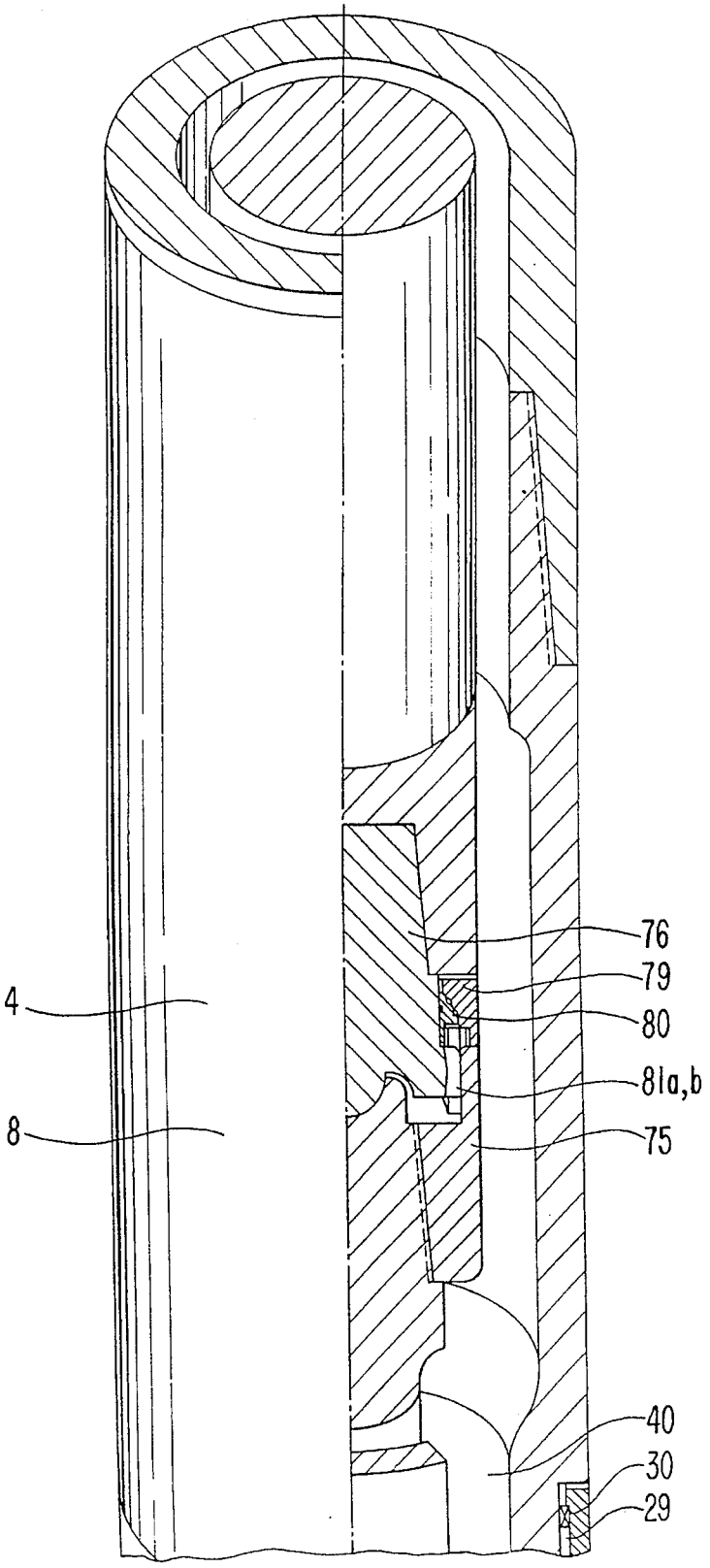
FIGS. 2A–2D are partial sectional illustrations of a connecting housing.
Figure 2B:
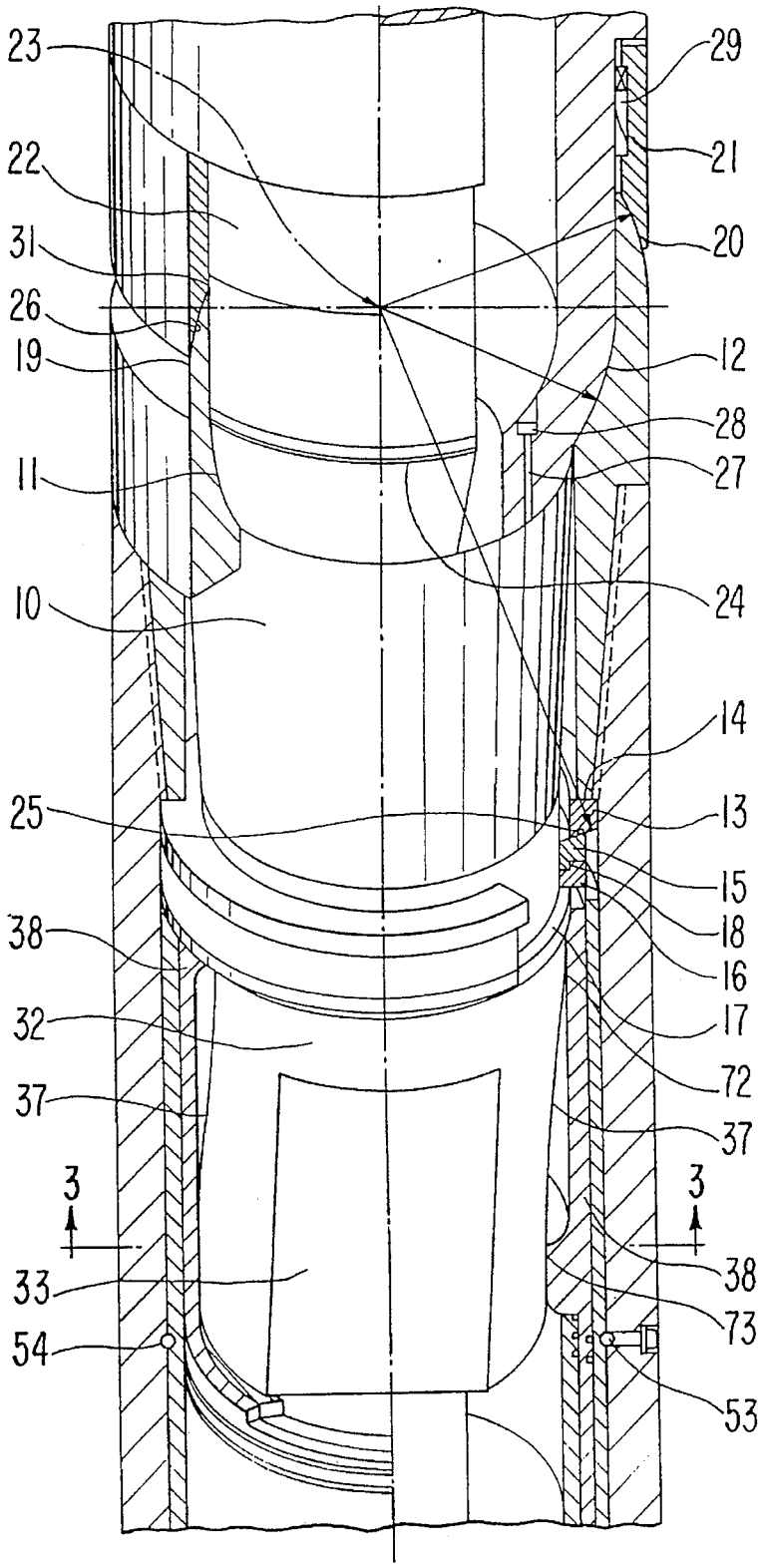
Figure 2C:
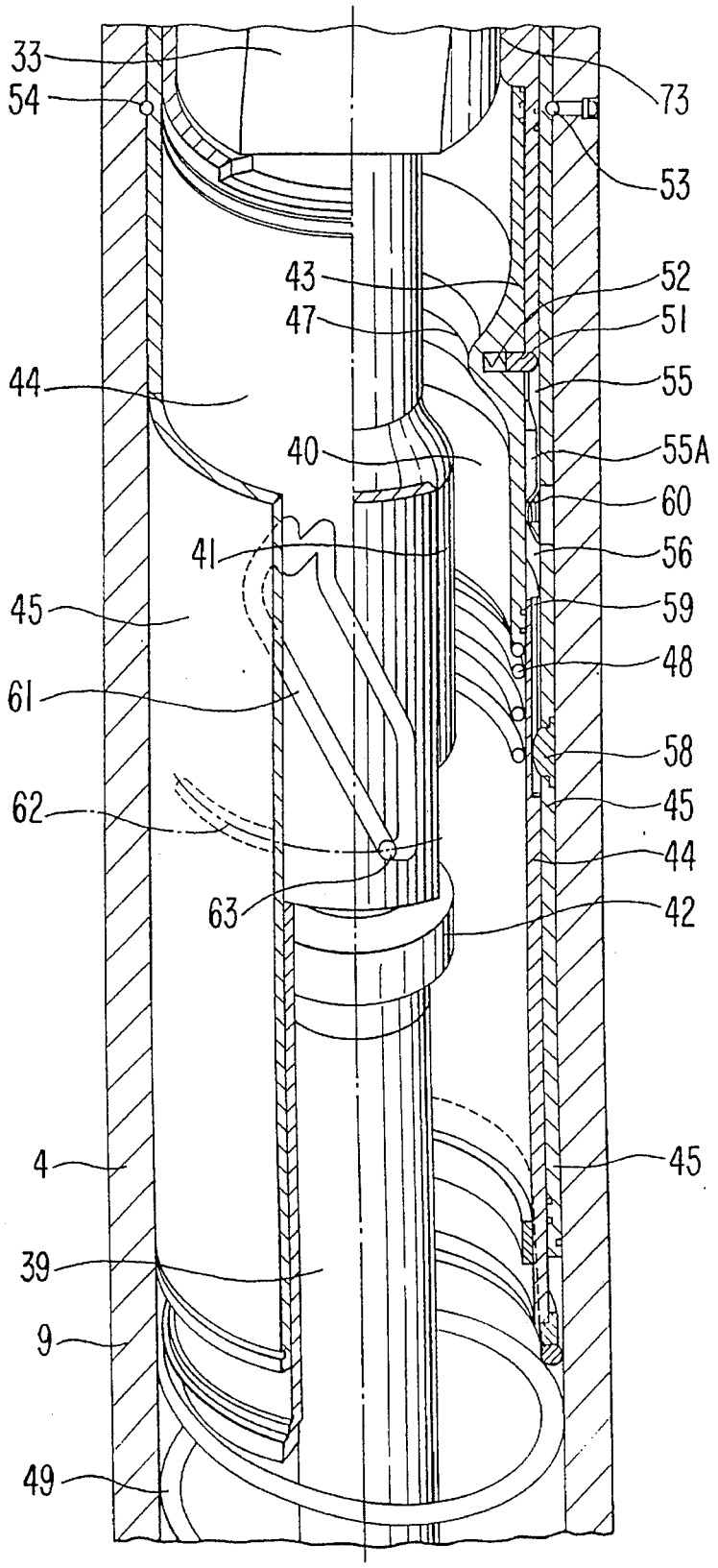
Figure 2D:
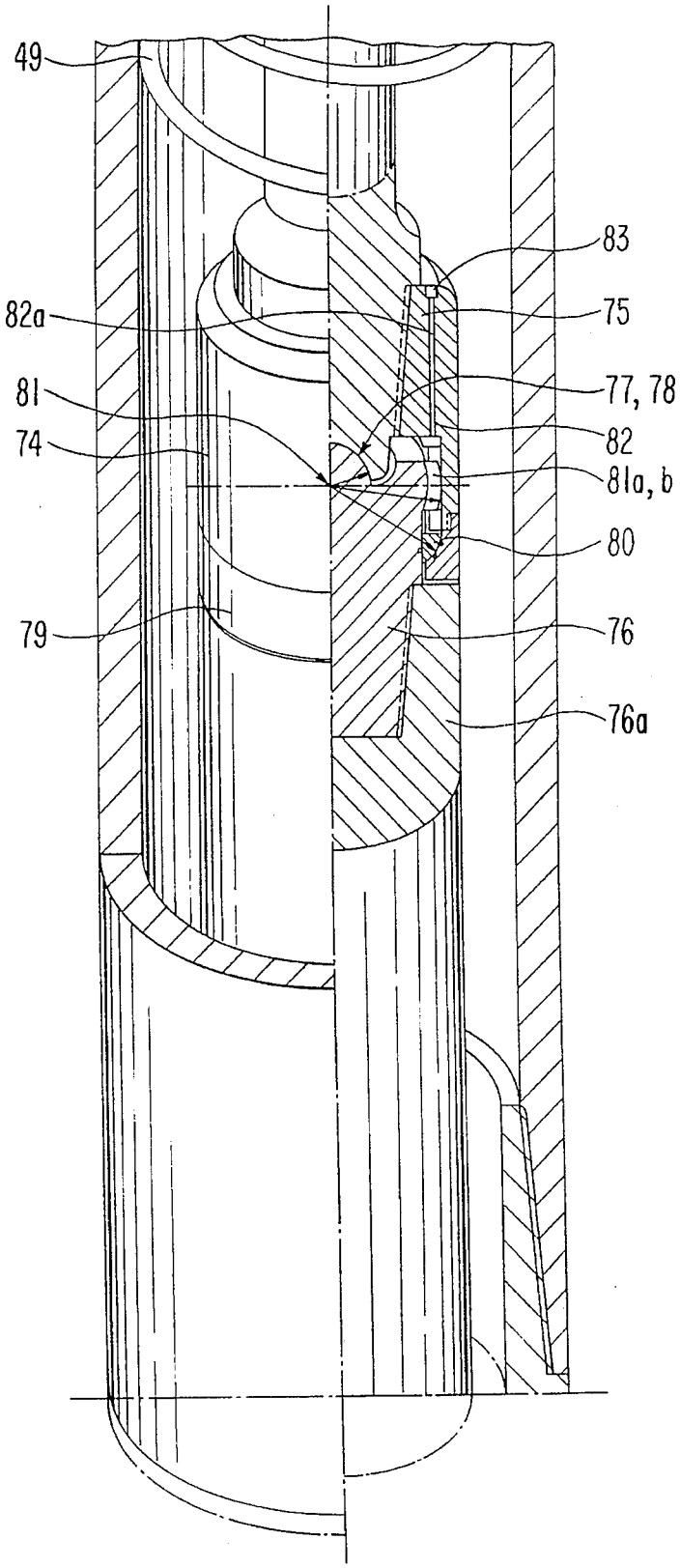

FIGS. 3A–3C are cross-sectional illustrations of the end of the inserting adjusting organ (32), as well as a partial longitudinal view of this part. The segments (35) are provided in the shown embodiment as loose components, which are secured against rotation about the centerline of the lower housing part (9) by circular wedges (36), which rest in half circular shaped grooves arranged in the segments (35) and the inner side of the lower housing part (9), parallel to the center line of the lower housing part (9). The parallel surfaces (33) and (34) serve to transfer a heavy torque moment from one housing part to the other, allowing both housing parts (8, 9) to hinge only in one plane with respect to each other.

Perpendicular to the parallel surfaces (33) and (34) (FIG. 2) adjusting surfaces (37) are provided opposite to each other at the outer circumference of the inserting adjusting organ (32), which run under an angle with respect to the centerline of the adjusting organ (32). Against these surfaces (37) rests adjusting organs (38), which are supported at opposing sides on the inner surface of the lower housing part (9), or inserted part of the second sleeve (45). In cross-section (see FIG. 3) the adjusting surfaces (37) and the surfaces of the lower housing part (9) or second sleeve (45), to which the adjusting organs support, have a segment-circular shape.

By displacing the adjusting organ (38) with respect to the inserting adjusting organ (32), the upper housing part (8) is displaced hinging around the rotation center point (23) with respect to the lower housing part (9).

Referring again to FIGS. 2A–2D, the invention divides the transmitting zones for large axial pressure forces, axial pulling forces and torque moments from one housing part to the other. A heavy connecting shaft (39) is conveyed through the hinging bent housing. In addition, a sufficiently large annular flow area (40) can be realized for the drilling fluid.

A helicoil motor can be provided, according to the invention, to accommodate for the misaligned eccentric wobbling rotation of the connecting shaft with respect to the concerning housing part in case the adjustable bend is located in the connecting housing or between two drive motor sections.

According to the embodiment illustrated in FIG. 2A–2D, an adjusting system in the lower housing part includes the following main components which cooperate with each other: The connecting shaft (39) on which thickening (41 and 42) are located; a piston sleeve including a piston shaped thrust body (piston part) (43) which envelopes the connecting shaft (39), and a sleeve (44), which envelopes the piston part (43), and to which the adjusting organs (38), which cooperate with the inclining adjusting surfaces (37) on the inserting adjusting organ (32), are connected; and a second sleeve (45) which envelopes the sleeve (44).

The piston part (43) is provided with an annular flow opening through which the connecting shaft (39) is passed and which allows for a sufficiently large flow channel (40) between the connecting shaft (39) and the enveloping piston part and sleeve (43, 44). The inner surface of the piston part and sleeve (43, 44) is profiled, such that, a contraction (47) is present in the flow channel, providing a hydraulic resistance. The piston part (43) is provided with a soft spring (48) that acts against the direction of flow, and which is supported in the enclosing sleeve (44).

The sleeve (44) is provided with a strong spring (49) that acts against the direction of flow, and which is supported in the lower part of the lower housing part (9). The second sleeve (45) is rotationally fixed (see FIGS. 3A–3C) in the lower housing part (9), which eases manufacturing and assembling, and locks the segments (35) in an axial direction. Fixation in the axial direction (see FIGS. 2A–2D) is realized by the insertion of balls (53) in tangential grooves (54) provided in the inner circumference of the lower housing part(9) and the outer circumference of the second sleeve (45).

In the second sleeve (45) a fixed pawl (58) is accommodated, which inserts into a groove (59) provided within the sleeve (44). A pawl (60), loaded by a spring (60*a*), also fits in the groove (56).

FIGS. 4A–4L illustrate a number of spring (52) loaded ratchets (51) installed in the piston part (43) and which can be displaced in the grooves (55 and 56), and over a surface (55A) of the sleeve (44) situated therebetween. The piston part (43) is secured against rotation with respect to the sleeve (44) by a pin groove connection, which is not shown in the drawing.

Referring to FIGS. 3A–3C, the adjusting organs (38) are connected to the sleeve (44), which at the outside rest against the segments (35) and against the inserting parts of second sleeve (45), by which the adjusting organs (38) are rotationally fixed.

At the outer circumference of the sleeve (44), a number of closed loop grooves (61) are provided with a deformed heart shaped pattern. At the inner circumference of the second sleeve (45), tangential grooves (62) are provided.

Figure 4C:
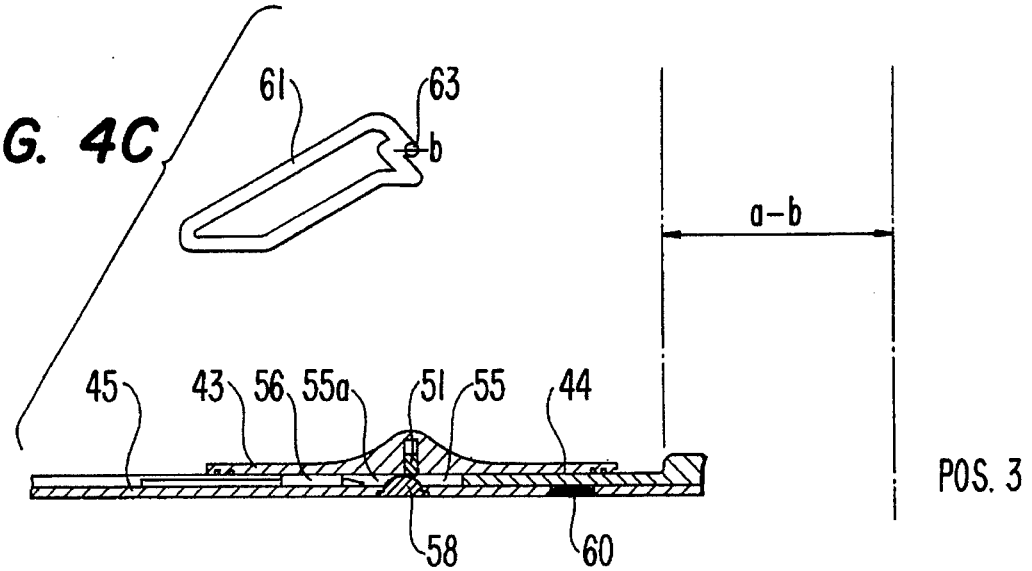
FIGS. 4A–4L are schematic illustrations of the adjusting system in different locations.
Figure 4B:
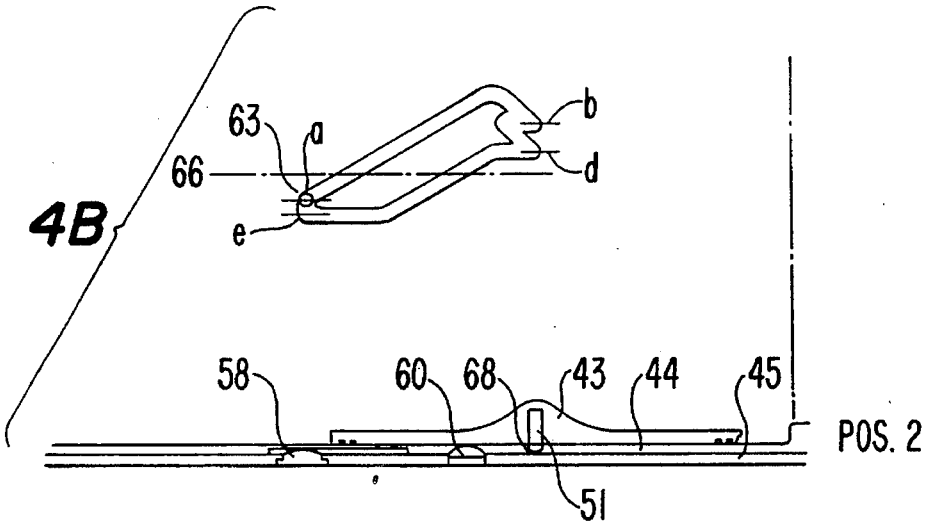
Figure 4A:
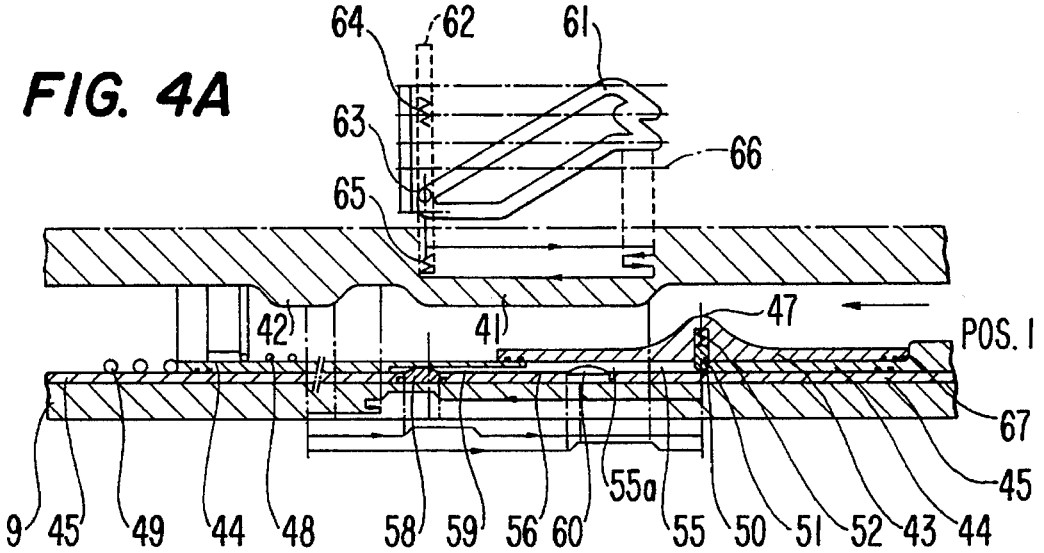
Figure 4J:
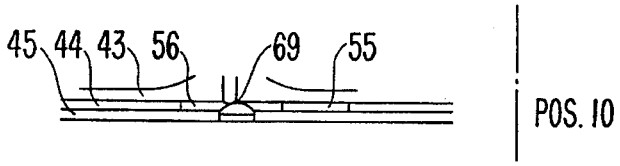
Figure 4I:
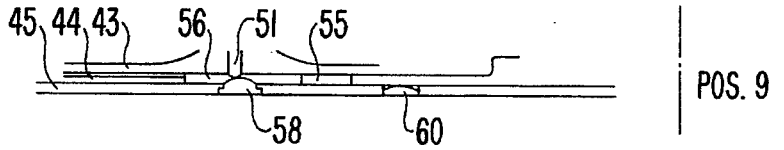
Figure 4H:
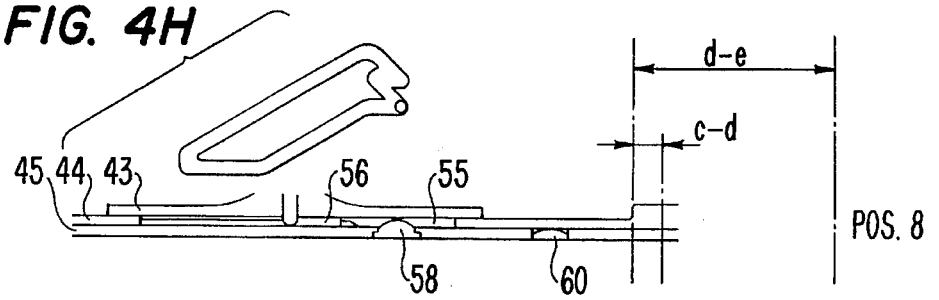

The two sleeves (44 and 45) are interconnected with each other using balls (63) located in groove (61). The balls (63) are loaded by springs (64 and 65) at both sides. Springs (64, 65) are accommodated in the tangential grooves (62). The neutral load lines (66) are situated between the points a and d, as shown in FIGS. 4A–4C.

FIGS. 4A–4L are schematic overviews of different important positions of components of the adjusting system with respect to the lower housing part (9), and the second sleeve (45). The functioning of the system will be explained with the help of positions, which demarcate different working phases.

First activation phase before adjusting

In the starting position the system is in position 1. The piston part (43) bears against the stop (67) of the sleeve (44). The ratchet (51) is situated in an extended position at the beginning of the groove (55) in an up-flow direction, while the contraction (47) is situated in a position some distance from the first thickening (41) of the connecting shaft. The soft spring (48) is sized, dimensioned, and assembled with pretension, so that a small change in massflow with respect to the required maximum operating massflow will displace the piston part (43) in the direction of the flow, from position 1 to position 2.

Adjusting phase

In position 2 the ratchet (51) bears against the stop edge (68) in the groove (55), so that in the direction of the flow, the piston part (43) is locked with respect to the sleeve (44). The restriction opening of the piston part (43) is thus situated at a level near the beginning of the first thickening (41) of the connecting shaft, so that as a consequence of the contraction of the flow channel (40), the thrust-force on the piston part (43) and the sleeve (44) is increased. The piston part (43) and the sleeve (44) are displaced together under this increased force in the direction of the flow to position 3, against the force of the strong spring (49).

The ball (63) has been displaced in the closed groove, from position a to position b. The adjusting organs (38) connected to the sleeve (44) are displaced by the thrust-force induced on the sleeve (44), with respect to the inserting adjusting organ (32) (see FIGS. 2A–2D) under intensification, depending on the angle of the slope of the adjusting surfaces (37), from adjusting-force to setting-force, which is exercised perpendicular to the axial shaft of the lower housing part (9) on the adjusting organ (32). The upper housing part (8) and the lower housing part (9) are thus hinged to each other at the corresponding setting angle.

Locking phase

By the combined forward displacement of the piston part (43) and the sleeve (44), the ratchet (51) is lifted in position 3 by the fixed pawl (58), and the piston part (43) is unlocked from the sleeve (44). As the force of the strong backing spring (49) is working on the sleeve (44) and almost no hydraulic force is present, sleeve (44) moves against the direction of the flow to position 4, whereby the ball (63) is displaced in the groove (61) from position b to position c, and the sleeve (44) is locked in the upflow direction with respect to the lower housing part (9) and the second sleeve (45).

Locking position—signaling phase

At the moment of disconnecting of the piston part (43) and the sleeve (44), a large hydraulic force and an opposite opposing small contracting force of spring (48) are working on the piston part (43). The hydraulic force is large due to the position of the contraction (47) with respect to the end of the first thickening (41) on the shaft. As a consequence of this, the piston will quickly displace downflow to a balanced position 5, wherein the hydraulic force is in balance with the force of the soft spring (48). The ratchet (51) is let down, during this phase, into the groove (56). By the relative fast displacement of the contraction (47) from a position with a small flow channel to one with a much larger flow channel, a large, detectible negative pressure drop or pulse in the drilling fluid occurs.

Massflow—restoring phase

After detection of the negative pressure drop or pulse, the massflow of drilling fluid can be adjusted back to the original operating massflow. The piston part (43) then displaces to position 6, until the ratchet arrives at the stop edge (69).

Second activation phase for delocking

For unlocking of the adjusting mechanism, the massflow is changed in a positive way by a relatively small value, by which the thrust force on the piston part (43) increases again, until this force becomes larger than the force of the soft spring (48). The piston part (43) then moves to position 7, where the ratchet (51) arrives at the stop edge (70) of the groove (56).

Delocking phase

The contraction (47) is now situated near the second thickening (42) of the connecting shaft. Thus, a much higher thrust force is exerted on the piston part (43), which displaces the piston part (43) and the sleeve (44) together to position 8, whereby the ball (63) is displaced from position c to position d, and blocks the piston and the cylinder from further displacement in the downflow direction. The mechanism is then in the unlocked position in the upflow direction.

Restoring phase

By decreasing the massflow to zero or a reduced value, the piston part (43) and the sleeve (44) will displace in the upflow direction, while the cooperating adjusting organs (38) restore the position, under the urging of the strong spring (49).

During this phase two cases may occur:

(A) The backward movement of the piston part (43) overrules that of the sleeve (44), and the piston part (43) moves backward faster than the cylinder. In position 9, the ratchet (51) is lifted by the fixed pawl (58) and falls back in the groove (55).

(B) Alternatively, the ratchet (51) remains in groove (56) and is only lifted in position 10 when the sleeve (44) is again in the starting position. The spring loaded pawl (60) is only then in the pushed out position 10. The ball (63) in this phase is displaced from position d to position e and subsequently back to position a.

Figure 4G:
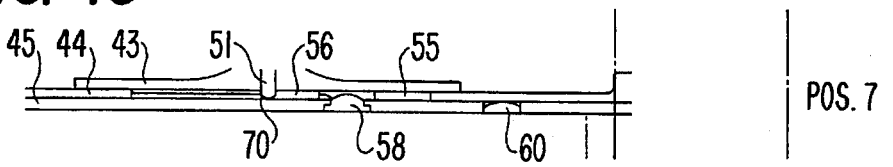
Figure 4F:
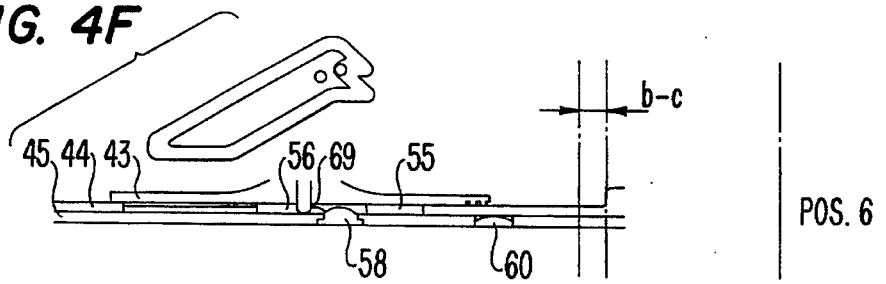
Figure 4E:
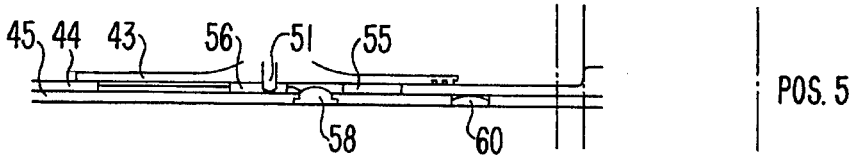
Figure 4D:
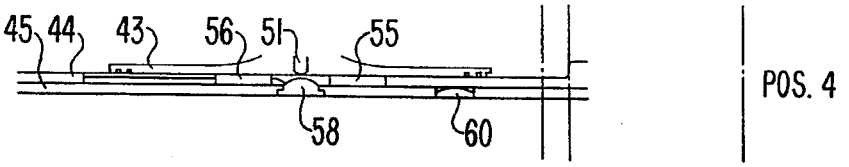
Figure 4K:
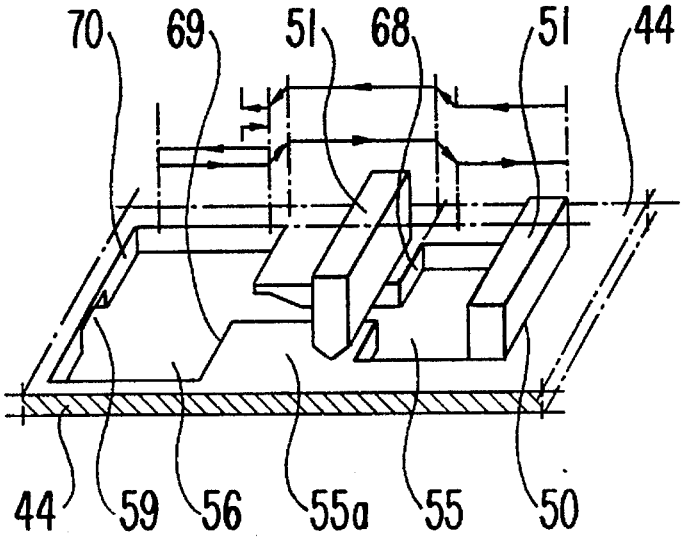
Figure 4L:
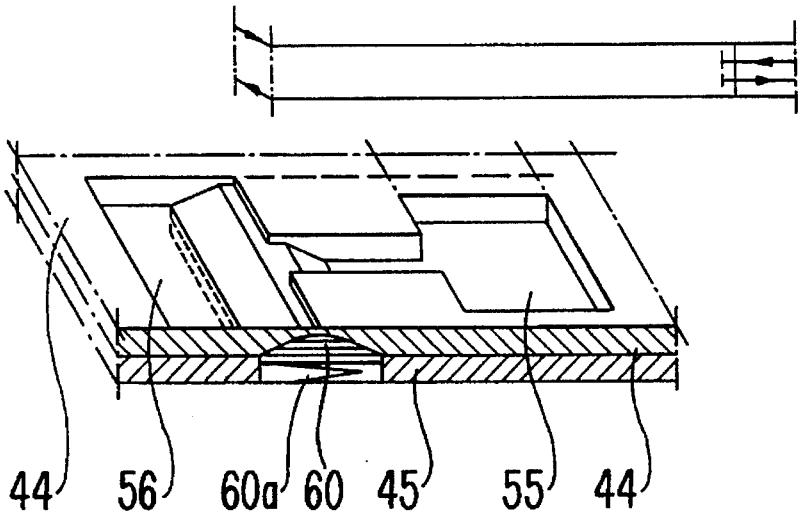
Figure 5A:
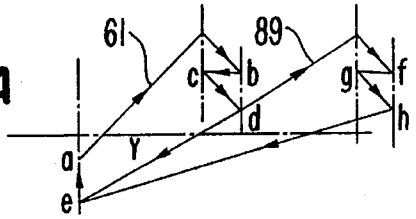
FIGS. 5A–5D are schematic illustrations of an alternative embodiment of the adjusting system, illustrating three different positions.
Figure 5B:
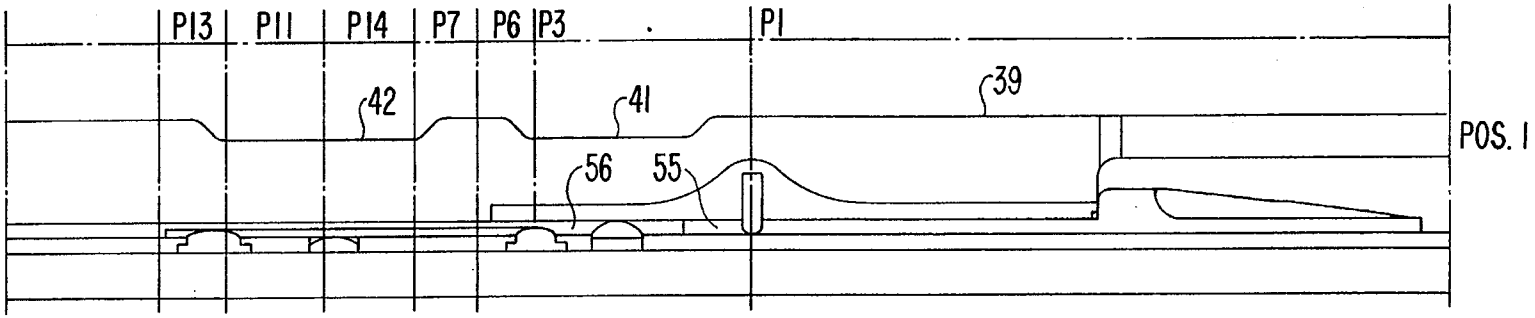
Figure 5C:
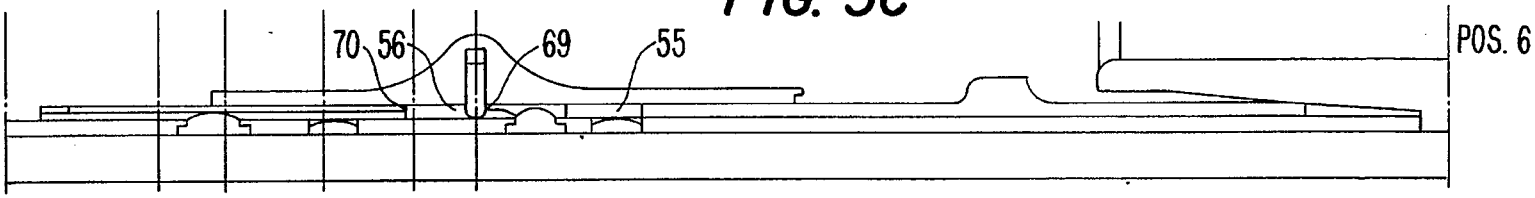
Figure 5D:
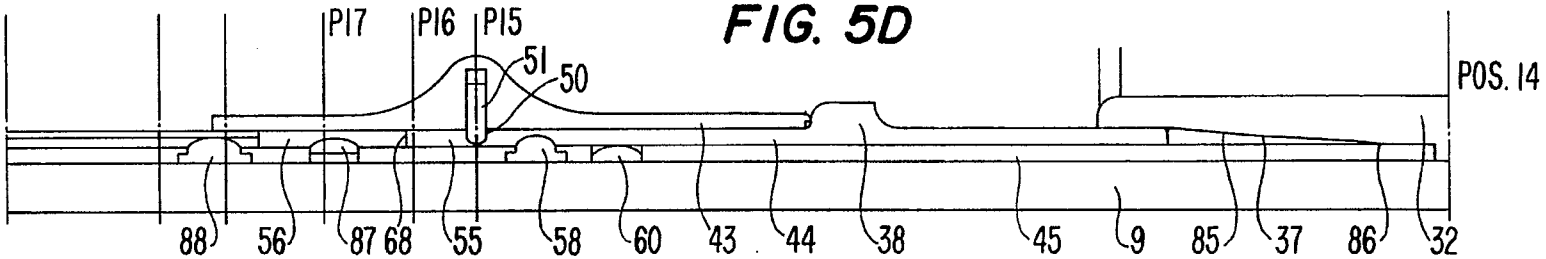

In FIG. 4K, the movement of the ratchet (51) is illustrated with respect to the grooves (55, 56) in the sleeve (44), in the following order of the above described phases. In FIG. 4L, the movement of the spring loaded pawl (60), with respect to the sleeve (44), is given in the following order of the discussed phases.

Groove (55) is smaller in width than groove (56), and groove (59) is smaller in width than groove (55). The spring loaded pawl (60), which has the same width as groove (56), can only in the starting position of the sleeve (44) in the groove (56) be in the forced out position, by which the pawl cannot influence the remaining operation of the adjusting system. Groove (55) and groove (56) may also have the same width. The spring loaded pawl (60) or pawls fit or fits, in different embodiments, in recesses which are incorporated in the sleeve (44).

The inserting adjusting organ (32) and the adjusting organs (38) are provided with end surfaces (72) and (73) of a certain length, which are parallel to each other at the point where they reach their set position. As shown in FIGS. 3A–3C, the adjusting organs in cross-section have a segmented circular surface, so as to have a significant surface available to solidly fix the adjusting organs (32, 38), and thus the housing parts (8) and (9), with respect to each other, in the set positions. Upon locking, the adjusting organs (38) move backward over a short distance; the end surfaces (73) on the adjusting organ (32) are extended to allow for this. The ratchet mechanism in the piston part (43) with cooperating grooves and pawls, the locking mechanism of grooves, and the balls are situated, in cross-sectional view, at an angle with respect to each other. The number of these mechanism can be one or more, depending on the execution.

In FIGS. 2A–2D, showing the embodiment of the invention, the adjustable bend piece is accommodated in the housing parts (8) and (9) at the motor side. This has the consequence, that in case the drive motor is a helicoil motor, one has to take care of the misalignment and the noncentric rotating connecting shaft (39), and also the wobbling movement which the motor shaft makes during rotation. In case the adjustable piece is accommodated between two segments of the drive motor housing, the connecting shaft also eccentrically rotates.

In the adjustable bend piece, in comparison with fixed bend pieces, components are accommodated, which further limits the rotating space of the connecting shaft (39). Thus, the presently known flexible couplings of the tulip type cannot be used for this invention, as they have play and are strongly subjected to wear. Thus, as a consequence of the shaft hitting against the internal components of the housing part, the known flexible coupling are quickly destroyed.

The invention aims to solve this problem effectively, by application of a totally new type of flexible coupling (74) consisting of a part (75) with outer teeth (**81*a*), and a part (76) with inner teeth (81*b***).

Part (75) includes a pivot surface (77), which in the shown embodiment is part of the connecting shaft (39) and which is connected to a screwed connection. A pivot surface (78) in part (76), which is connected to bearing shaft (**76*a*), bears against pivot surface (77) for the transfer of the high axial thrust force which the rotor imposes on the connecting shaft (39) in case a helicoil motor is used. To seal against drilling grit, between the two parts (75) and (76) at the outer side, a ring (79) is attached to part (75), and a ring (80) is provided around a contracted portion of part (76) are accommodated, and which are provided with grooves with elastic distorsionable sealing rings and/or scraper springs. The adjacent and abutting bearing surfaces of the teeth, pivot surfaces, and the surfaces of the rings which are bearing against each other all have a common spherical center point of rotation (81). In part (75), channels (82) are provided which contain movable plugs (82*a*) and which are connected to the drilling fluid side and to the internal space of the coupling. At the fluid side, the opening is provided with a recessed closing nut (83**) with an interconnecting opening.

A lubrication nipple and a closable deaerating opening are provided (not illustrated). The channels (82) with the movable plugs (**82*a***) serve for: compensation of differential pressure over the sealing rings; compensation for compression of air bubbles in case they are unexpectedly present after filling during assembling; and for compensation of leakage.

FIGS. 5A–5D illustrate another embodiment according to the invention, in which the angle of the bend piece can be adjusted in two steps.

The surfaces (37) (see also FIGS. 2A–2D) on the inserting part (32) of the upper housing part (8) are constructed in two steps (85, 86), against which the adjusting organ (33) bears. Aside of the pawls (58) and (60), and the ratchets (51), additional fixed pawls (88) and spring loaded pawls (87) are provided. The spring loaded pawl (87) can only be in the pushed out position when the interconnecting ball (63) is located in position 9 and the adjusting organs are in the second set position 14.

On the outside of the sleeve (44), as shown in FIG. 2A–2D the grooves (61) are extended with similar grooves (89) (see FIG. 5) and the tangential grooves (62) at the inner side of the second surroundings sleeve (45) are maintained, between which spring loaded interconnecting balls are situated in both groove sides.

With this adjusting system, one can shift over the first step as previously described with respect to the embodiment of FIGS. 2A–2D, and as described in conjunction with FIGS. 4A–4L, or shift on to the second step, so that the hinging angle of both housing parts (8 and 9) of FIGS. 2A–2D can be adjusted in two steps.

In FIGS. 5A–5D, only 3 main positions are shown, namely: the location position 1, which corresponds to the position 1 of FIG. 4A; the location position 6, which corresponds to the adjusted position 7 of FIG. 4G; and the location position 14, wherein the adjusting system has adjusted both housing parts (8) and (9) over the second angle and the operating condition is restored.

The way of operation for the second step will be explained, wherein adjustment over the first step has been carried out as described for FIGS. 4A–4F up to and including position 6.

Activation phase for adjustment of the second stroke

The operating massflow is increased by a relatively small value, so that the thrust pressure on the piston part (43) becomes larger than the opposed force of the soft spring (48). As a consequence, the piston part (43) is displaced downflow with respect to the sleeve (44), so that the inserted ratchet (51) arrives at the stop edge (70) of the groove (56), in accordance to position 7 of FIG. 4G.

Adjusting phase for the second stroke

At the end of the foregoing phase (position 7), the piston part (43) is locked downflow with respect to the sleeve (44) by the ratchet (51). As the contraction (47) is situated near the beginning of the second thickening (42) on the shaft, the thrust pressure on the piston part (43) is increased, and the piston part (43) and sleeve (44) move together downflow till position 11. The interconnecting ball (63) is displaced from c to f.

The adjusting organs (38), connected to the sleeve (44), are displaced with respect to the second inclined surface (85) on the set organ (32) under intensification of the adjusting force, to the set force. Both housing parts (8) and (9) hinge with respect to each other at the second adjusting angle.

Locking phase second stroke

With the combined forward displacement of the piston part (43) and the sleeve (44), the ratchet (51) is lifted out of the groove (56) by pawl (87), and the piston is delocked from the sleeve (44), position 11. Under the force from strong backing spring (49), the sleeve (44) moves backwards to position 12 (not shown in the figure), whereby the interconnecting ball is displaced from f to g, and the sleeve (44) is locked in the upflow direction with respect to the second sleeve (44) and lower housing part (9).

Locking position signaling phase second stroke

At the moment of delocking of the piston part (43) with respect to the sleeve (44) (position 11), a large thrust pressure is still exerted on the piston part (43), as the contraction is situated at the end of the second thickening (42) on the shaft. The piston part (43) is displaced quickly downflow to position 13 (an equilibrium position between thrust pressure and counter pressure of the spring (48)) by which a fast, detectable negative pressure drop occurs in the drilling fluid.

Massflow restore phase after second stroke

After detection of the negative pressure dip, the massflow is considerably reduced, by which the piston part (43) is displaced upflow with respect to the sleeve (44). The ratchet (51) falls back in the groove (56) and is lifted in position 14 by the strip loaded pawl (87), which can only then be in the pushed out position, when the interconnecting ball (63) is located in position g. The piston then moves further upflow where the ratchet (51) falls back into groove (55) and arrives at the stop (50) in position 14, blocking further displacement of the piston part (43). The massflow is then restored to the original operating massflow.

Activation phase for the second delocking

The massflow is increased by a relatively small amount with respect to the operating massflow. The piston part (43) moves until the extended ratchet (51) in the groove (55) arrives at the stop (68). The contraction (47) is then located in position 16 near the level of the beginning of the second thickening.

Delocking phase of the second stroke

Because the contraction (47) is situated at the level of the beginning of the second thickening (42), the thrust pressure is increased, and the piston part (43) and the sleeve (44) are displaced together downflow, until the interconnecting ball (63) has moved from position g to position h. The adjusting mechanism then is in the delocked condition (position 17) and the interconnecting ball is in position h.

Restoring phase after second stroke

By a considerable reduction of the massflow, the piston part (43) and sleeve (44) move together to the starting location (position 1) under the influence of the adjusting force of the strong spring (49).

Figure 6:
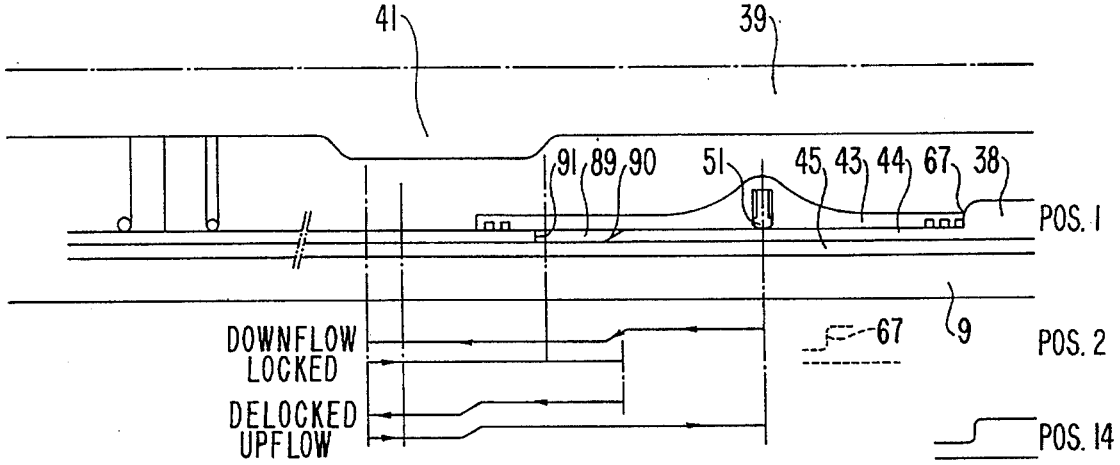
FIGS. 6 and 7A–7D are simplified schematic illustrations of alternative embodiments of the present invention.

In FIG. 6 a simplified embodiment of the invention is shown. This includes one groove (89) having a ratchet lifting edge (90) and no pawls. In the starting position, the piston part (43) is accommodated one stroke further upflow then as shown by the embodiment in FIGS. 2A–2D.

At the outside of the sleeve (44) and the inside of the second sleeve (45), or at the inside of the lower housing part (9), two similar grooves are provided with a doublesided, spring-loaded, interconnecting ball, as in FIGS. 2A–2D.

The contraction (47) of the piston part (43) displaces first till ratchet (51) abuts against the stop edge (91), after which the piston part (43), as well as the sleeve (44), are displaced further downflow, until the interconnecting ball (63) arrives at b (FIG. 4C), when further displacement is prevented.

By decreasing of the massflow, the sleeve (44) moves backwards till the ball (63) arrives at c (position 2, FIG. 4B) and the piston part (43) moves further backwards. The ratchet (51) is lifted by the inclined edge (90) prior to the piston part (43) hitting the stop edge (67). The adjusting organ (38) is then situated in the dotted position 2. The path of movement of the ratchet is shown in FIG. 6.

For the delocking, the piston part (43) is activated again. The piston part (43) is displaced downflow till the ratchet (51), after first having been let down in the groove (89), arrives at the stop edge (91), after which the piston part (43), as well as the sleeve (44), move together downflow, until the ball (63) arrives at d (see FIG. 4H). By decreasing the massflow, the piston part (43) and sleeve (44) move upflow. The sleeve (44) is displaced until the ball (63) reaches e, and the piston part (43) moves further backwards. The ratchet (51) is lifted by the inclined edge (90) prior to the piston part (43) hitting the stop edge (67). The up and down path of movement of the ratchet is shown in FIG. 6.

In FIGS. 7A–7D a further embodiment of the invention is shown. In this embodiment, a ball or barrel shaped ratchet (92) is accommodated in a recess (98) in the piston part (43), replacing the spring loaded ratchet of the prior embodiments. In the starting position, ratchet (92) is situated at the upstream side (93) of a groove (94) in the sleeve (44), while downstream, in the second sleeve (45) or in the lower housing part (9), a recess (95) is provided. In contrast to the previous embodiment, on the outer circumference of the piston part (43), a closed groove (96) is located. In the inner side of the sleeve (44), an interconnecting ball or pin (63) is situated, which partly projects into groove (96), not indicated in the figures. The groove (96) may have a zigzagging closed shape over the total circumference, with the locking positions corresponding with the in and out hook shape.

By activation, the piston part (43) is displaced downstream, until the ratchet (92) arrives at the stop edge (97) of the groove (94), after which the piston part (43) and the sleeve (44) move together downstream, whereby the housing parts (8) and (9) hinge with respect to each other. When the ratchet (92) reaches the recess (95), the ratchet (92) then moves into recess (95), whereby the sleeve (44) is locked with respect to the second sleeve (45) and/or the lower housing part (9).

As the contraction (47) is still situated at the end of thickening (41), it will move under the influence of the thrust pressure, initially quickly and afterward slowing to its end position. The ball (63) will then have been displaced from a to b in the groove. By decreasing the massflow, the piston part (43) moves upstream until the ball (63) is situated at c, and the piston part (43) is then locked with respect to the sleeve (44) in this position, as well as the position of both housing parts (8 and 9) with respect to each other.

For the restoring of the position of both housing parts (8 and 9) with respect to each other, the piston part (43) is activated again, by which it is displaced downstream until the ball (63) is situated at d. After decreasing the massflow, the piston part (43) moves upstream. At the moment that the recess (98) in the piston part (43) is situated above the recess (95) in the sleeve (44), the ratchet (92) displaces out of the recess (95), and into the recess (98), by which the sleeve (44) is unlocked and the piston part (43), as well as the sleeve (44), move backwards to the starting position under the influence of the spring forces, and both housing parts (8 and 9) are adjusted with respect to each other to the starting position.

By the up and down movement, the piston part (43) rotates up and down around its axial centerline depending upon the width of the pattern of the groove (96). At the end positions a, b, c and d, the groove (96) is executed with short extensions, such that by the backward movement the piston part (43) is forced to rotate a little, so that the ball (63), as a consequence of the friction working against the direction of rotation, is forced in the correct direction.

Concerning the various embodiments, as circumstances require and depending on the position of the adjustable bend piece, the adjusting system can also be located upstream with respect to the adjustable bend piece. The location of the components of the adjusting system with respect to each other is then adapted accordingly, and the axial compression springs can be substituted by two or more tension springs. One adjusting system may also cooperate with two bend pieces.

If an adjustable bend piece with adjusting system is situated above the drive motor, the motor shaft can be elongated at the top side, or a fixed shaft can be applied in this part.

In a further embodiment, the adjusting system includes a pressure sensor, a decoding unit, a current source, as well as a circuit which can energize a locking mechanism. Thus, the activation system can be blocked, so that it will not activate if not desired. The advantage of this is that the activation system is no longer dependent for its action on a value above the operating massflow, and therefore, no margin has to be reserved. A further advantage is that if more then one adjustable bend pieces is provided, the adjusting systems of each bend piece can be activated independently from each other. The current sources, for example, can be incorporated into the thickening of the pistons, at the contraction, or in the axial thickened shoulders in the piston.

Figure 8:
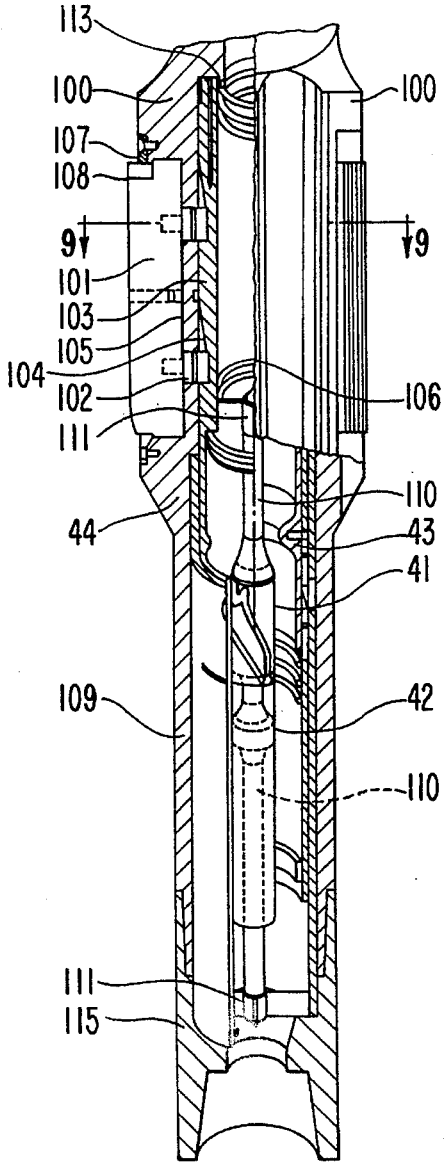
FIGS. 8 and 9 are a partial longitudinal perspective view and a cross-sectional view of a stabilizer, respectively with FIG. 9 being taken along section line 9—9 in FIG. 8.
Figure 9:
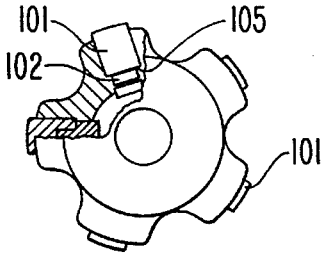

FIG. 8 and 9 give an illustration of an embodiment, as an example, of a partly exploded longitudinal perspective view and a cross-section view of a stabilizer, which is incorporated in a drillstring, in which the components of the adjusting system, and other components of this stabilizer can be seen partly in longitudinal section and in partly in cross-sectional view.

The stabilizer housing (100) is provided with stabilizer blades (101) radially adjustable into two positions and to which adjusting organs (102) (32) are connected, and which bear against an adjusting organ (103) (38) which in an axial direction is provided with stepped shaped adjusting surfaces (104). Adjustability in more positions can be easily provided. By displacement of the adjusting organ (103) (38) in the direction of the flow, the adjusting organs (102) (32) and the stabilizer blades (101) are displaced radially to the outside, by the inclined part of the adjusting surfaces (104), against the force of the spring (105), until they are situated in the second adjusted position. By displacement of the adjusting organ (103) (38) in the upstream direction, the stabilizer blades (101) and adjusting organs (102) (32) move back under the influence of the spring (105) to the original first set position. Displacement limiting plates (107) and stop edges (108) prevent the blades from escaping out of the housing.

In the example, it can be seen that the adjusting system is incorporated in an elongated housing part (109). The shaft (110) (39) with thickening is loosely incorporated within the stabilizer housing, and is radially supported by rings provided with arms (111) in the second surrounding cylinder, and radially and axially gliding in the adjusting organ (103) (38). The downstream supporting ring (111) is axially supported in the elongated housing part (115). The strong spring (106) (49) is locked between a locking edge (113) of the sleeve (44) and the arms of the upstream located supporting ring (111).

Embodiments, by which the stabilizer blades extend asymmetrically, can be realized by adapting the adjusting surfaces (104) of the adjusting organ (103) (38) to this. Stabilizer blades also can be incorporated at one side.

Stabilizers made with stabilizer blades at one side only can also be applied to steer the bit by force, for example in hard geological formations, bypassing of a fish, or to drill short radius boreholes. The apparatus is accommodated between the bend and the bit, and serves as a pushoff pad (shoe) (116). The adjusting system can, if desired, be integrated in the adjusting system of the adjustable bend housing.

Figure 10:
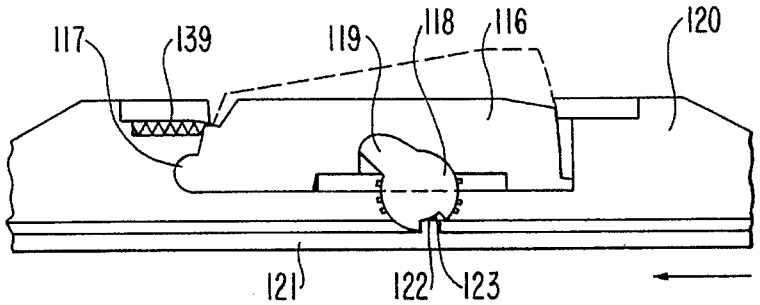
FIG. 10 is an alternative embodiment of a stabilizer blade, push-off pad and housing.
Figure 7A:
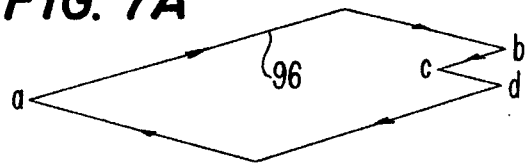
Figure 7B:
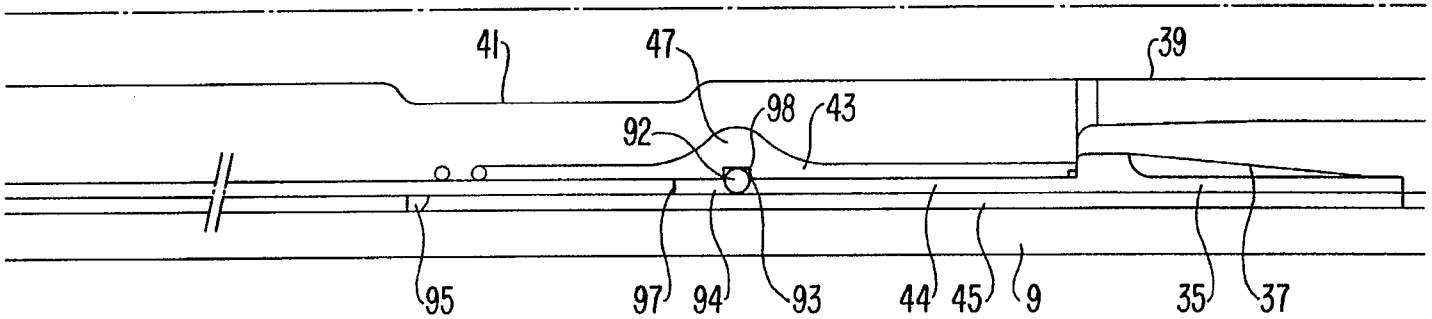
Figure 7C:
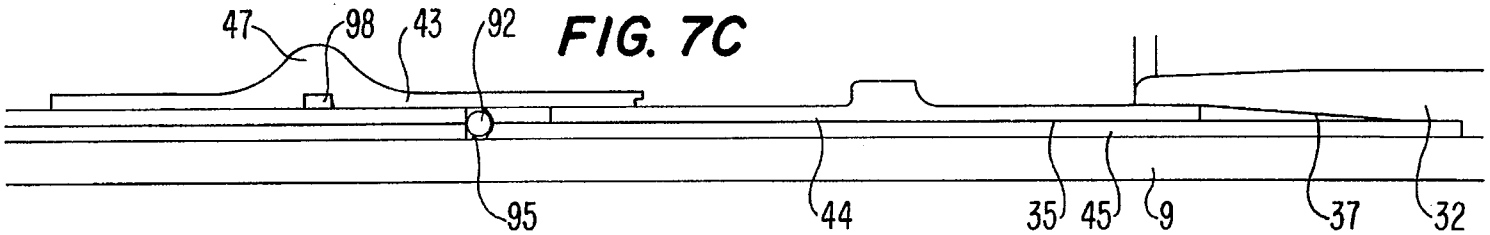
Figure 7D:
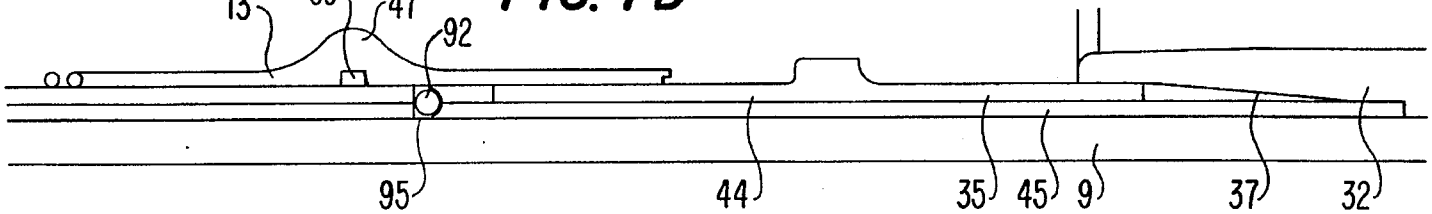

FIG. 10, for example, schematically illustrates an alternative embodiment of a stabilizer blade, pushoff pad (116), and its housing and remaining components. The pushoff pad (116) hinges around a downstream located pawl (117). A tumbler (118) (32) hinges the pushoff pad (116) to the outside by a tumbler arm (119), when this rotates clockwise. By counter rotation, the pushoff pad (116) hinges back under the influence of the spring (138) in its housing (120). The rotation of the tumbler is actuated by the adjusting organ (121) (38), on the outside of which a groove is located with a fixed shoulder or pawl (122). By the downflow displacement of the adjusting organ, the pawls (122) engage a recess (123) in the tumbler (118) (32), thereby rotating the tumbler. By the upstream movement of the adjusting organ (121) (38), a reverse rotation takes place by the adjusting mechanism.

Figure 11:
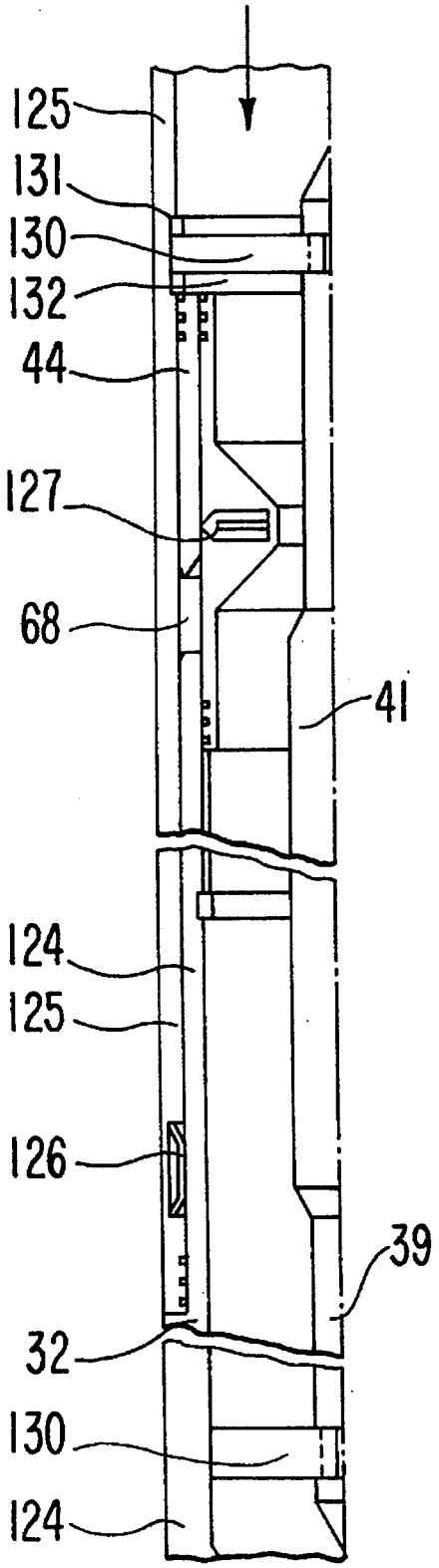
FIGS. 11 and 12 are schematic, longitudinal sectional views of a telescoping housing.

In FIG. 11, a schematic, half-longitudinal section is illustrated of an embodiment with two in-and-out telescoping housing parts (124) and (125) and with two set lengths.

This embodiment is similar to the adjusting system as illustrated in FIG. 6, with the understanding that spring loaded pawls (126) (60) are incorporated to lift the ratchet (127) (51) near the extended position, while the locking mechanism between both string (pipe) parts (124) (44) and (125) is not shown. In this adjusting system, sleeve (44) is not provided with a strong spring (49), as the inward telescoping of the string parts (124) (44) can take place simply by placing the bit on the bottom and by applying pressure.

Figure 12:
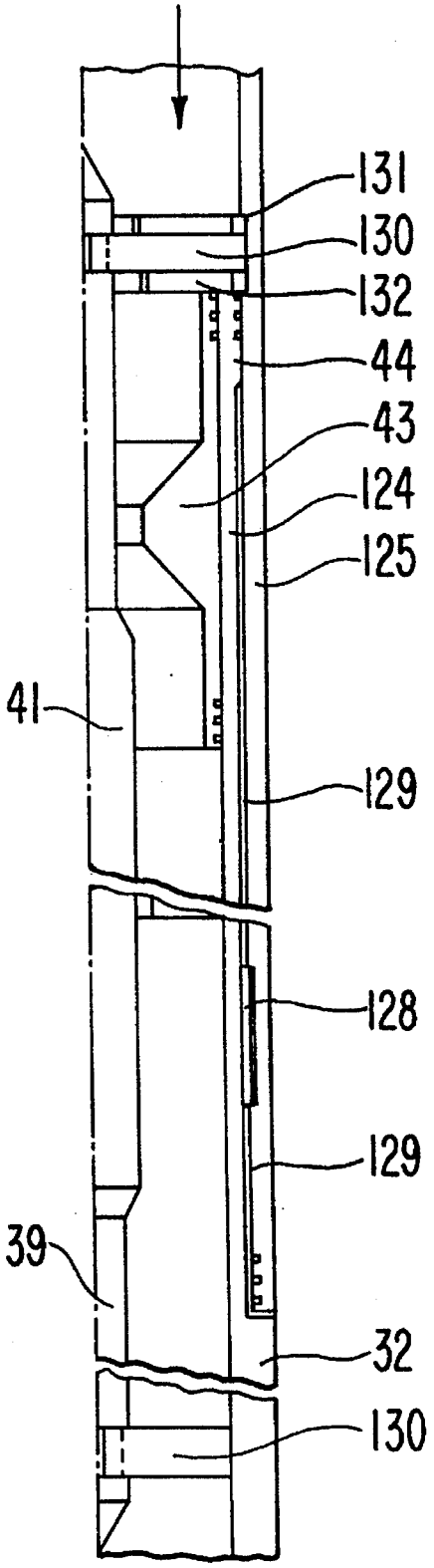

In FIG. 12, a schematic, half-longitudinal section is illustrated of an embodiment in which a wedge (128) and a wedge groove (129) transfer the torque moment from one to the other main string part (124) (125). FIGS. 11 and 12 illustrate that the shaft (39) with thickening (41) is supported in the string parts by rings provided with arms (130), which support the shaft radially in the string parts (124) (125), by which the downstream ring can glide in the string part (124), and the upstream ring is axially restrained with respect to string part (125), by two spring mounted retaining rings (131) and (132).

Figure 13:
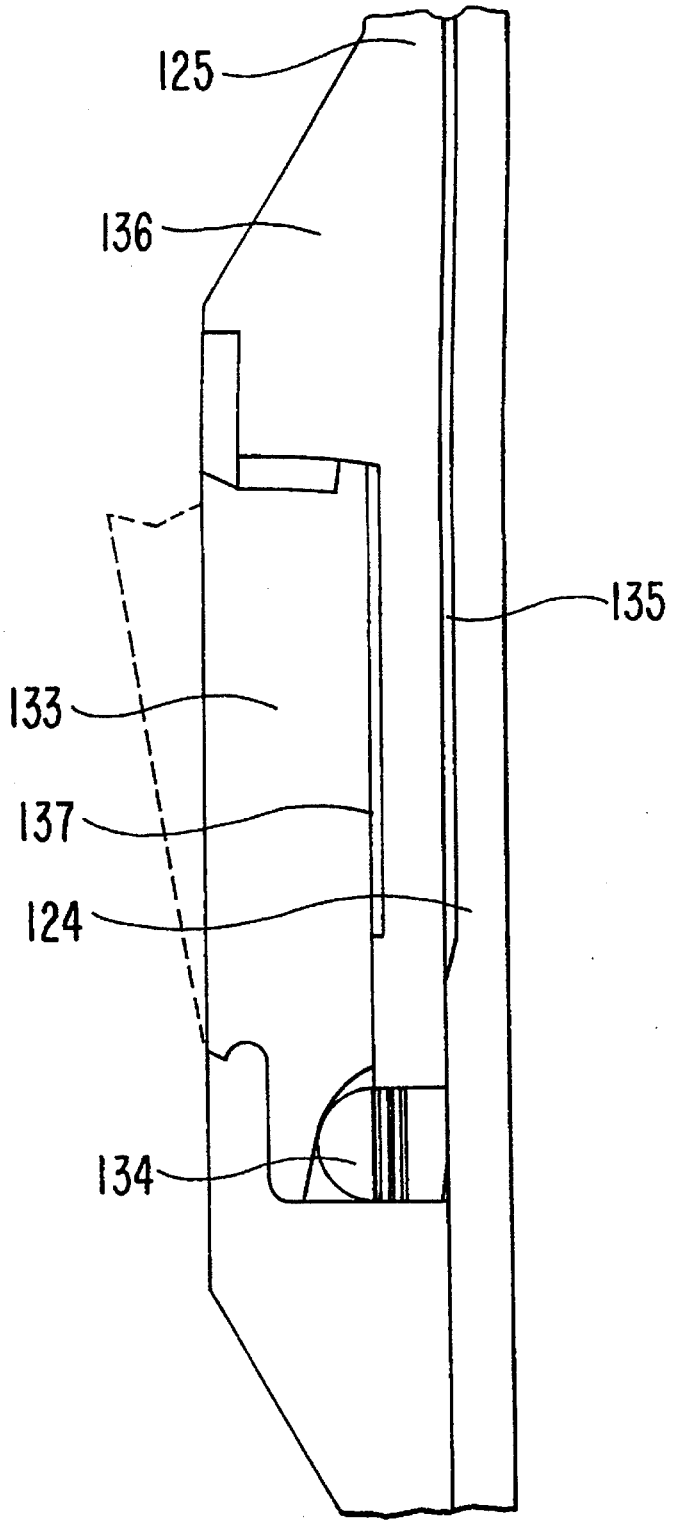
FIG. 13 is a longitudinal, sectional view of a clamp and housing, according to the invention.

FIG. 13 schematically illustrates a half-longitudinal section of an embodiment of a clamp (133) (claw), its own housing (136), and remaining components. In case the adjusting organ (38), or from FIG. 11 and 12, string part (124), moves with respect to string part (125) downstream, the adjusting organ (134) is displaced inward against the stepped adjusting surface (135), and the claw (133) hinges out of its housing (136) under the influence of the force of the spring (137). The displacement occurs in the reverse direction by the inward telescoping of both string parts.

The telescopic embodiment can be applied for the following applications:

The elongation of the drillstring between the bit and the stabilizer located at a certain distance upstream therefrom, for changing of the length of the drillstring for tune steering of the direction of drilling, by which the system is provided with a locking mechanism with one or more positions. In the event of an increase of the bit pressure near the end of the drillstring, by very long bore holes, and lateral drilling, depending on the available push-off pressure against the drillstring, a claw mechanism can be applied which can secure the upflow part step wise to the wall of the borehole under steering of the massflow.

The present invention proposes providing an apparatus whereby the drillstring can move forward independently. A strong spring is incorporated in the apparatus, and each string part includes a claw system, such that the drilling system moves forward independently, under steering of the massflow.

I claim:

1. A drill string having a steerable forward end, comprising:

(A) a housing defining an up and down position;

(B) a shaft within said housing and having a first end for connection to a motor and including a bit connected to a second end thereof, said shaft having a thickened portion;

(C) drilling fluid within said housing and having an operating mass flow rate and a direction of flow;

(D) a reciprocating sleeve piston enclosed within said housing and being displaceable between at least two end positions by a mass flow of said drilling fluid, said sleeve piston having a central opening for the passage of said drilling fluid, said central opening having said shaft extending therethrough, said sleeve piston comprising:

(1) a displaceable sleeve being movable between two positions within said housing;

(2) a first spring having a first end urging against said sleeve, and a second end urging against said housing;

(3) a piston part coaxial with Said sleeve and being displaceably slidable within said housing, said piston part having an inwardly directed collar being movable towards said thickened portion of said shaft by an increase of the mass flow rate of the drilling fluid above the operating mass flow rate whereby said collar and said thickened portion cooperate to reduce a size of said central opening, the reduced size of said central opening causing said drilling fluid to exert a thrust pressure on said piston part so that said piston part and said sleeve are moved abuttingly together against the urging of said first spring to an adjusting position; and (4) a second spring exerting a spring force less than said first spring and having a first end urging against said sleeve, and a second end urging against said piston part; and (E) an adjusting organ connected to said sleeve and being displaceable when said sleeve piston is in the adjusting position.

2. The drill string as defined in claim 1, wherein said sleeve includes a groove having end stops and said piston part has a ratchet insertable into said groove, said groove and said ratchet limiting the movement of said piston part with respect to said sleeve.

3. The drill string as defined in claim 2, further comprising a pawl within said housing; said ratchet including a spring for urging said ratchet into said groove, and said sleeve including a contracted portion and a second groove connected to said first groove via said contracted portion, said pawl lifting said ratchet out of said first groove so that said ratchet passes over said contracted portion to subsequently fall into said second groove.

4. The drill string as defined in claim 3, further comprising a further pawl within said housing and being in front of said pawl relative to the direction of flow, said further pawl including a spring for urging said further pawl into a path of movement of said sleeve, and said further pawl moving said ratchet out of said first and second grooves.

5. The drill string as defined in claim 4, further comprising another pawl similar to one of said pawl and further pawl, said another pawl being positioned behind said further pawl and said pawl relative to the direction of flow.

6. The drill string as defined in claim 1, wherein said sleeve includes a groove having a first end with an end stop and a second end having an inclined surface, and said piston part has a ratchet insertable into said groove, said inclined surface lifting said ratchet out of said groove.

7. The drill string as defined in claim 1, further comprising a locking mechanism for locking of said displaceable sleeve and being activated by the reciprocating motion of said sleeve piston, said locking mechanism having at least two end positions corresponding to the end positions of said sleeve piston.

8. The drill string as defined in claim 7, further comprising a fixed sleeve within said housing and an interconnecting element including a ball and a plurality of springs; said housing including an inner surface surrounding said fixed and displaceable sleeves, and said locking mechanism comprising a first and second bowl-shaped channel surrounding said ball, one of said channels being within an outer surface of one of said displaceable sleeve and said fixed sleeve and the other of said channels being within said inner surface of said housing, said first channel forming a closed loop having a first and a second position for said ball corresponding to a rest position and the adjusting position, respectively, of said piston, said ball being reciprocatingly positioned within its first and second positions with the respective reciprocating movement of said sleeve piston, and said second channel being tangentially arranged and having said ball forced by said plurality of springs into an equilibrium position therein.

9. The drill string as defined in claim 8, wherein the closed loop forms a zig-zag pattern in the region of the second position.

10. The drill string as defined in claim 1, wherein said housing includes an upper and a lower portion corresponding to the up and down positions, respectively, said upper and lower portions being joined together by a hinge comprising a spherical shaped surface and a bowl shaped surface slidingly engaging each other, said hinge further comprising a segment shaped element limiting a sliding movement of said spherical and bowl shaped surfaces so that said upper and lower portions are hingable in only one plane.

11. The drill string as defined in claim 1, wherein the shaft connections to said bit and said motor each include a flexible coupling.

12. The drill string as defined in claim 11, wherein each said flexible coupling comprises a first part having internal teeth, and a second part having external teeth for engaging with said internal teeth, each said flexible coupling further comprising a portion having a spherical shaped surface and a portion having a bowl shaped surface pivotally engaging each other.

13. The drill string as defined in claim 1, further comprising a pressure differential compensating device having a through bore and a movable plug within said bore.

14. The drill string as defined in claim 1, further comprising a locking mechanism for locking of said displaceable sleeve, and an adjusting system comprising a pressure pulse sensor, a decoding unit, a current source, and a circuit for activating said locking mechanism.

* * * * *